US006482335B1

(12) United States Patent
Greene

(10) Patent No.: US 6,482,335 B1
(45) Date of Patent: Nov. 19, 2002

(54) CONDUCTIVE ADHESIVE AND METHOD

(75) Inventor: Roger W. Greene, Tulsa, OK (US)

(73) Assignee: Conley Corporation, Tulsa, OK (US)

( * ) Notice: Subject to any disclaimer, the term of this patent is extended or adjusted under 35 U.S.C. 154(b) by 0 days.

(21) Appl. No.: 09/858,969

(22) Filed: May 16, 2001

(51) Int. Cl.[7] ..... H01B 1/24
(52) U.S. Cl. ..... 252/511; 524/496
(58) Field of Search ..... 252/511; 156/327; 524/495, 496

(56) References Cited

U.S. PATENT DOCUMENTS

| | | | | |
|---|---|---|---|---|
| 4,115,338 | A | 9/1978 | Kobayashi et al. | 260/29.4 UA |
| 4,155,896 | A | 5/1979 | Rennier et al. | 260/37 M |
| 4,314,917 | A | 2/1982 | Wolfrey | 260/18 EP |
| 4,330,811 | A | 5/1982 | Bordner | 361/212 |
| 4,519,941 | A | 5/1985 | Anderson | 252/514 |
| 4,533,685 | A | 8/1985 | Hudgin et al. | 523/457 |
| 4,544,688 | A | 10/1985 | Salensky et al. | 523/458 |
| 4,557,860 | A | 12/1985 | DiSalvo et al. | 252/512 |
| 4,568,592 | A | 2/1986 | Kawaguchi et al. | 428/107 |
| 4,582,872 | A | 4/1986 | Hudgin et al. | 524/439 |
| 4,652,398 | A | 3/1987 | Goswami et al. | 252/514 |
| 4,664,971 | A | 5/1987 | Soens | 428/288 |
| 4,874,548 | A | 10/1989 | Hajovsky | 252/511 |
| 6,056,912 | A * | 5/2000 | Sohda et al. | 264/478 |

FOREIGN PATENT DOCUMENTS

| | | | |
|---|---|---|---|
| JP | 61-141778 | * | 6/1986 |

* cited by examiner

*Primary Examiner*—Mark Kopec
(74) *Attorney, Agent, or Firm*—Head, Johnson & Kachigian

(57) ABSTRACT

An electrically conductive adhesive composition and method of making and using the same comprising a thermosetting resin, a hardening agent, conductive carbon powder and conductive carbon fibers each having a length of about 13 mm long and a concentration of about eight percent (8%) by weight of the composition for promoting conductivity across bonds in systems designed to prevent build-up and storage of static electrical charges.

12 Claims, No Drawings

CONDUCTIVE ADHESIVE AND METHOD

BACKGROUND OF THE INVENTION

Field of the Invention

The present invention relates to conductive adhesives. More particularly, the present invention is conductive adhesive generally comprising a thermosetting resin, a hardening agent, carbon powder, and carbon fibers, and a method for obtaining and using the same. It is further contemplated that the invention and method of obtaining and using the same are applied in the construction of pipelines where it is desirable to provide a conductive adhesive for reducing or eliminating buildup of dangerous electrostatic charges. 2. Prior Art Pipelines have long been made from plastics, fiberglass, and other non-metal material. These non-metal pipes and pipelines are often preferred over metal pipelines because they are lighter weight, more corrosive resistant, and often more flexible. By the nature of these materials, theses non-metal pipes and pipelines tend to have a lower electrical conductivity than metal. This, however, is a potential disadvantage in certain applications, uses, and construction.

It is known that as material or fluid passes down a pipeline, static charges are created from friction as the material or fluid passes over the surface of the pipeline. It is not uncommon for these charges to build up to dangerous and damaging levels.

In the transportation of volatile substances via non metal type pipelines, such as associated with the petroleum industry, the discharge of accumulated electrostatic charges can cause catastrophic consequence. Furthermore, it is known that the industry has set standards in the transportation of petroleum products via ships that use fiberglass or plastic piping that such piping must have a surface resistivity of 10*9 ohms so that static charge build-up in the pipe by fluid flow may be conducted to ground. Thus, systems and materials have thus been adapted to reduce electrostatic charges associated with these non metal pipes and pipelines.

In an attempt to reduce the aforementioned hazards, the prior art has added electrically conductive materials to plastic sheets and pipes. For a further discussion of electrically conductive filament-reinforced plastic articles, see Bordner, U.S. Pat. No. 4,330,811 issued May 18, 1982. In Bordner, it is disclosed that pipes and other plastic articles are constructed such that higher electrical conductivity is achieved by adding fiberglass filaments with metal coatings to the articles.

In the construction process of plastic type pipelines, adhesives are used to bond segments of the pipe together. It is known to use conductive adhesives for the purpose of continuing conductivity across bonds in pipeline systems designed to prevent build-up and storage of static electrical charges. For a further discussion of such, see Hajovsky, U.S. Pat. No. 4,874,548 issued Oct. 17, 1989. Hajovsky discloses an electrically conductive adhesive composition comprising an epoxy resin and stainless steel fibers, or other conductive fibers, having a length of about 4 mm to about 8 mm (0.157 inches to 0.315 inches) at a concentration of less than five percent (5%) by weight.

The prior art of conductive adhesives has drawbacks such as but not limited to metal fiber which negatively impacts handling quality when used to formulate joints and fillets. The lack of elasticity of metal fibers in bending or flexing negatively affects the aesthetic and performance quality of the fabricated fillet.

SUMMARY OF THE INVENTION

In general, the present invention is a conductive adhesive generally comprising a thermosetting resin, a hardening agent, carbon powder, and carbon fibers generally 13 mm long and with a concentration of generally about eight percent (8%) by weight. It is further contemplated that the method of making such and using are part of the invention.

In this respect, before explaining at least one embodiment of the invention in detail, it is to be understood that the invention is not limited in this application to the details of construction and to the arrangement of the components set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is, therefore, an object of the present invention to provide a new and improved conductive adhesive and method for obtaining and using the same which continue conductivity across bonds in systems used in pipelines designed to prevent build-up and accumulation of static electrical charges.

It is a further object of the present invention to provide a new and improved conductive adhesive and method for obtaining and using the same which reduces the dangers and hazards associated with electrostatic charges.

An even further object of the present invention is to provide a new and improved conductive adhesive and method for obtaining and using the same which is of a more durable, reliable, and lasting construction than that of the prior art adhesives with conductive properties.

Still another object of the present invention is to provide a new and improved conductive adhesive and method for obtaining and using the same which is susceptible of a low cost of manufacture with regard to both materials and labor, which accordingly is then susceptible of low prices of sale to the consuming industry, thereby making such economically available to the buying public.

Another object of the present invention is to provide a new and improved conductive adhesive and method for obtaining and using the same which provides some of the advantages of the prior art, while simultaneously overcoming some of the disadvantages normally associated therewith.

Yet another object of the present invention is to provide a new and improved conductive adhesive and method for obtaining and using the same which provides a fiber with a high conductivity property in an amount that allows mixing and spreading.

Still yet another object of the present invention is to provide a new and improved conductive adhesive and method for obtaining and using the same which may be easily, efficiently, manufactured, used, and marketed.

It is a further object of the present invention to provide a new and improved conductive adhesive and method for obtaining and using the same which satisfy the consuming industry's need for an adhesive with functional parameters of such things as conductivity, setting time, and elasticity.

Furthermore, it is also an object of the present invention to provide a new and improved conductive adhesive and method for obtaining and using the same which provides a longer carbon fiber in combination with the carbon powder for assuring consistent high levels of conductivity.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the descriptive matter in which there is illustrated preferred embodiments of the invention.

DETAILED DESCRIPTION OF THE PREFERRED EMBODIMENTS

In accordance with the present invention there is provided a conductive adhesive comprising thermosetting resin and conductive fibers. In general, the present invention is a conductive adhesive generally comprising a thermosetting resin, a hardening agent, carbon powder, and carbon fibers generally 10 to 15 mm and in a preferred embodiment about 13 mm (about 0.5118 inches) long and with a concentration of generally about seven to nine percent and in a preferred embodiment about eight percent (8%) by weight.

EXAMPLES

The following examples further illustrate embodiments of the present invention including preferred versions and methods of making the same; however, these examples are not to be construed as limitations of this invention. The following examples are defined as parts and percentages by weight unless otherwise indicated and introduce a change in the examples from percent to parts by weight.

The thermosetting resins are mixed with curing agents, also known as hardeners, in specified ratios which are generally expressed in parts per hundred (pph).

Example 1

In a preferred embodiment, the conductive adhesive formulation is generally about 27 parts of hardener (part B) to cure 100 parts of resin (part A). A preferred embodiment of a Part A generally comprises as follows:

100 part by weight resin 50 part by weight conductive carbon powder 12.5 part by weight conductive carbon fiber 2.5 part by weight fumed silica (CAB-O-SIL TS-720)

Total weight=165 part by weight

A preferred embodiment of a Part B hardener generally comprises as follows:

27 part by weight hardener 13.5 part by weight conductive carbon powder 4.3 part by weight conductive carbon fiber Total weight=44.8 part by weight The combined weight of the preferred embodiment of Part A and Part B when used with proper formulation would be 165 part by weight plus 44.8 part by weight for a total of about 209.8 part by weight.

Conductive additives are generally formulated with conductive carbon fiber and conductive carbon powder. A preferred embodiment of conductive carbon fiber is a length of about 0.5 inches (13 millimeters). A preferred embodiment of carbon powder is about 0.00177 inches (less than 45 microns).

The total weight of conductive fiber in the combined formulation would be 12.5 part by weight plus 4.3 part by weight for a total of about 16.8 part by weight.

The percentage of total weight of conductive fiber in the preferred embodiment is 8%, which represents a 60% increase over the prior art adhesive formulation of 5% by weight of fiber.

Furthermore, the preferred embodiment contains 63.5 part by weight of conductive carbon powder, particle size 0.00177 inches, or less than 45 microns in size. This represents 30.3% of the total weight of the combined formulation.

The combined weight of conductive material in the preferred embodiment is 38.3% of the combined total adhesive weight. This represents a 666% increase over the 5% by weight of conductive material as described in the prior art.

Example 2

In a preferred embodiment of a conductive adhesive sold under the trade name C-WELD sold by Conley, Part "A" generally comprises:

40 parts per weight epoxy resin (828 tank resin)

20 parts per weight conductive carbon powder (filler)

5 parts per weight conductive carbon fiber (filler)

In this preferred embodiment of the above example, Part "B", the hardener generally comprises:

12 parts per weight cyclophatic amine (PACM higher temperature performance)

8 parts per weight aliphatic amine adduct 10 parts per weight conductive carbon powder (filler)

3.2 parts per weight conductive fiber (filler)

Example 3

In a preferred embodiment of a conductive adhesive sold under the trade name MIX-35.PRO—Pfizer Conductive Furex—bulk and batch sold by Conley, Part "A" generally comprises:

40 parts per weight epoxy resin 20 parts per weight conductive powder 5 parts per weight conductive fiber 1 parts per weight fumed silica (CAB-O-SIL TS-720)

Premix/Resin=1.65/1

In this preferred embodiment of the above example, Part "B", the hardener generally comprises:

12 parts per weight cyclophatic amine (PACM higher temperature performance)

8 parts per weight aliphatic amine adduct 10 parts per weight conductive powder 3.2 parts per weight conductive fiber Premix/Hardener 1.66/1

Of note, the above procedure should be followed wearing the proper PPE, including an organic respirator. Review MSDS and safety procedures regarding Epoxy resin.

METHOD OF PRODUCING

A preferred embodiment of a conductive adhesive in accordance with the present invention is generally described below.

a) Obtaining a mixing pot such as but not limited to an 80 quart metal mixing pot;

b) Add about 40 parts per weight of epoxy resin (828 tank resin);

c) Remove the mixing pot from scale;

d) Using a plastic trash bag or other such cover, tape the open end to the edge of the mixing pot;

e) Place the mixing pot onto a mixer such as but not limited to a HOBART mixer;

f) Cut the end out of the plastic trash bag and pull it up to the top edge of the mixing machine. Tape it into place but allow open space to add powders;

g) Turn mixer on in first gear (low speed) and begin to add 20 parts per weight of conductive carbon powder;

h) When all of the conductive carbon powder has been added and blended, move mixer into 2D gear (medium speed);

i) Add about 5 parts per weight conductive carbon fiber and mix for about 6–7 minutes;

j) Check mix to make sure all ingredients have been thoroughly blended in; and k) Remove mixing pot from mixer;

METHOD OF USING CONDUCTIVE ADHESIVE

In a preferred embodiment, the conductive adhesives made in accordance with the present invention has the same performance characteristics as the pipe joint to be bonded, generally has a tensile shear of 2000 pounds per square inch, a shelf life of approximately 2 years at room temperature, and a pot life after mixing at about 80 degrees Fahrenheit of about 30 minutes at ¼ inch thickness.

A preferred embodiment of conductive adhesive is sold under the trademark C-WELD by CONLEY which is a two component adhesive pre-measured, ready to mix and recommended for using with Epoxy Pipe Systems.

Another preferred embodiment of conductive adhesive is sold under the trademark ESTERWELD by CONLEY which is a two component adhesive pre-measured, ready to mix and recommended for using with vinyl ester or epoxy pipe systems.

Still another preferred embodiment of conductive adhesive is sold under the trademark FUREX by CONLEY which is a two component adhesive pre-measured, ready to mix and recommended for using with Furan Pipe Systems.

MIXING

In a preferred embodiment, recommended tools for mixing a conductive adhesive made in accordance with the present invention are but are not limited to putty knife, cardboard sheet and "tongue depressor" or paint stir stick as an applicator. Thoroughly mix the two parts on the cardboard sheet using the putty knife until there are generally no streaks. Scrape and clean the putty knife frequently to insure all material is included in the mixture.

When thoroughly mixed, evenly spread the conductive adhesive over the mixing board to about a ¼ inch thickness. This "unbulking" prevents hot spots from developing in the mix, shortening the pot life.

Any unmixed conductive adhesive will not cure and will cause soft spots in the glue line. In addition, unmixed adhesive generally has no strength, chemical resistance or heat resistance, and is a potential joint failure.

GLUING PROCEDURE

In a preferred embodiment of gluing or bonding joints with a conductive adhesive made in accordance with the present invention, apply the glue to the two surfaces to be bonded and assemble the segments which form the joint. Once together, do not allow the joint to move until the adhesive has cured. Generally, the conductive adhesive does not have the strength required and movement may cause voids or microfractures resulting in leaks.

The glue must generally reach "B Stage" before it can be properly cured. This may be done with a heat tape set at low for 30 to 45 minutes. The actual time depends on the ambient temperature, and if 95 degrees Fahrenheit or above, "B Stage" may be reached without the heat tape. The glue has "B Staged" if it is hard and does not leave a residue when touched.

See Table 1 below to determine a preferred cure time required at various heat tape settings. Of note, this preferred embodiment of the conductive adhesives generally requires heat to cure.

CURING

In a preferred embodiment, proper cure of a conductive adhesive made in accordance with the present invention requires the use of a pipe weld curing tape or comparable heat source. Table I below indicates the approximate final stage curing times at different temperatures for a preferred embodiment of the conductive adhesive. The initial "B Stage" is accomplished either by high ambient temperature or with a low temperature setting on the heat tape. "B Stage" is achieved when remaining adhesive on the mixing board is hard to the touch.

TABLE 1

| Ambient Temperature | Pipe Size | Heat Tape-A "B Stage" Time Setting | Heat Tape-B "B Stage" Time Setting | Heat Tape-A Full Cure Time Setting | Heat Tape-B Full Cure Time Setting | Total Cure Time |
|---|---|---|---|---|---|---|
| 80–90° F. | ALL | 30 Min. Low-Med | 30 Min.-"2" | 1 Hr.-High | 1 Hr.-Full | 1 Hr.-30 Min. |
| 70–80° F. | 1" to 4" | 30 Min. Low-Med | 30 Min.-"2" | 1 Hr.-High | 1 Hr.-Full | 1 Hr.-30 Min. |
| 70–80° F. | 6" to 12" | 45 Min. Low-Med | 45 Min.-"2" | 1 Hr.-High | 1 Hr.-Full | 1 Hr.-45 Min. |
| 70–80° F. | 14" to 30" | 1 Hr. Low-Med | 1 Hr.-"2" | 1 Hr.-High | 1 Hr.-Full | 2 Hr. |
| Below 70° F. | ALL | 2 Hr. Low-Med | 2 Hr.-"2" | 2 Hr.-High | 2 Hr.-Full | 4 Hr. |

Whereas, the present invention has been described in relation to the drawings attached hereto, it should be understood that other and further modifications, apart from those shown or suggested herein, may be made within the spirit and scope of this invention.

Changes may be made in the construction and the operation of various components, elements and assemblies described herein or in the steps or the sequence of steps of the methods described herein without departing from the spirit and scope of the invention as defined in the following claims.

What is claimed is:

1. An electrically conductive adhesive composition comprising:

a thermosetting resin and conductive carbon fibers each having a length of about 10–15 mm long, wherein said conductive carbon fibers have a concentration of about seven to nine percent by weight of the composition.

2. The composition of claim 1 further including a hardening agent.

3. The composition of claim 1 further including conductive carbon powder.

4. The composition of claim 1 further including fumed silica.

5. The composition of claim 1 further including cyclophatic amine.

6. The composition of claim 1 further including aliphatic amine adduct.

7. The composition of claim 1 wherein said fibers have a length of about 13 mm.

8. The composition of claim 1 wherein said concentration is about eight percent (8%) by weight of the composition.

9. An electrically conductive adhesive composition comprising a resin blend and an adhesive hardener blend wherein:

the resin blend comprises about 100 part by weight resin, about 50 part by weight conductive carbon powder, about 12.5 part by weight conductive carbon fiber, and about 2.5 part by weight fumed silica; and the adhesive hardener blend comprises about 27 part by weight hardener, about 13.5 part by weight conductive carbon powder, about 4.3 part by weight conductive carbon fiber.

10. The composition of claim 9 wherein said conductive carbon fibers each further having a length of about 13 mm long.

11. The composition of claim 9 wherein said conductive carbon powder each further having a diameter of about 45 microns.

12. The composition of claim 9 wherein said conductive carbon powder each having a diameter of less than 45 microns.

* * * * *